US011060793B2

(12) United States Patent
Ehmann

(10) Patent No.: US 11,060,793 B2
(45) Date of Patent: Jul. 13, 2021

(54) BATCH FURNACE FOR ANNEALING MATERIAL AND METHOD FOR HEAT TREATMENT OF A FURNACE MATERIAL

(71) Applicant: Gautschi Engineering GmbH, Berg TG (CH)

(72) Inventor: Rainer Ehmann, Bodman-Ludwigshafen (DE)

(73) Assignee: Gautschi Engineering GmbH, Berg TG (CH)

( * ) Notice: Subject to any disclaimer, the term of this patent is extended or adjusted under 35 U.S.C. 154(b) by 106 days.

(21) Appl. No.: 16/197,942

(22) Filed: Nov. 21, 2018

(65) Prior Publication Data

US 2019/0162474 A1 May 30, 2019

(30) Foreign Application Priority Data

Nov. 28, 2017 (DE) ..... 102017128076.6

(51) Int. Cl.
*F27D 7/04* (2006.01)
*F27B 5/14* (2006.01)
(Continued)

(52) U.S. Cl.
CPC ..... *F27D 7/04* (2013.01); *C21D 1/767* (2013.01); *C21D 9/0043* (2013.01); *C22F 1/04* (2013.01);
(Continued)

(58) Field of Classification Search
CPC ..... C21D 1/767; C21D 9/525; F27B 17/0016; F27B 5/14; F27B 5/16; F27B 2005/168;
(Continued)

(56) References Cited

U.S. PATENT DOCUMENTS 3,019,006 A * 1/1962 Lillienberg ..... C21D 9/663 432/199
3,708,156 A 1/1973 Leland
(Continued)

FOREIGN PATENT DOCUMENTS

CN 1033840 A 7/1989
CN 202709720 U 1/2013
(Continued)

OTHER PUBLICATIONS

Office Action issued in DE102017128076.6, dated Jul. 17, 2018.
The Extended European Search Report issued in European patent application No. 18208226.3 dated Mar. 21, 2019, 12 pages.

*Primary Examiner* — Scott R Kastler
(74) *Attorney, Agent, or Firm* — Hamre, Schumann, Mueller & Larson, P.C.

(57) ABSTRACT

The present invention relates to a batch furnace for annealing material comprising a furnace housing which has a closable loading opening, a receiving chamber for furnace material and a device for convective heat transfer to the furnace material by a heat transfer medium, wherein the device for convective heat transfer comprises at least one heating device and at least one fan which is arranged in the furnace housing wherein the receiving chamber is arranged on the suction side of the fan and at least one nozzle array is arranged on the pressure side of the fan, wherein the nozzle array has a central opening which forms an intake duct of the fan and the nozzle array projects radially beyond the fan. The invention further relates to a method for heat treatment of a furnace material.

20 Claims, 2 Drawing Sheets

Figure 1:
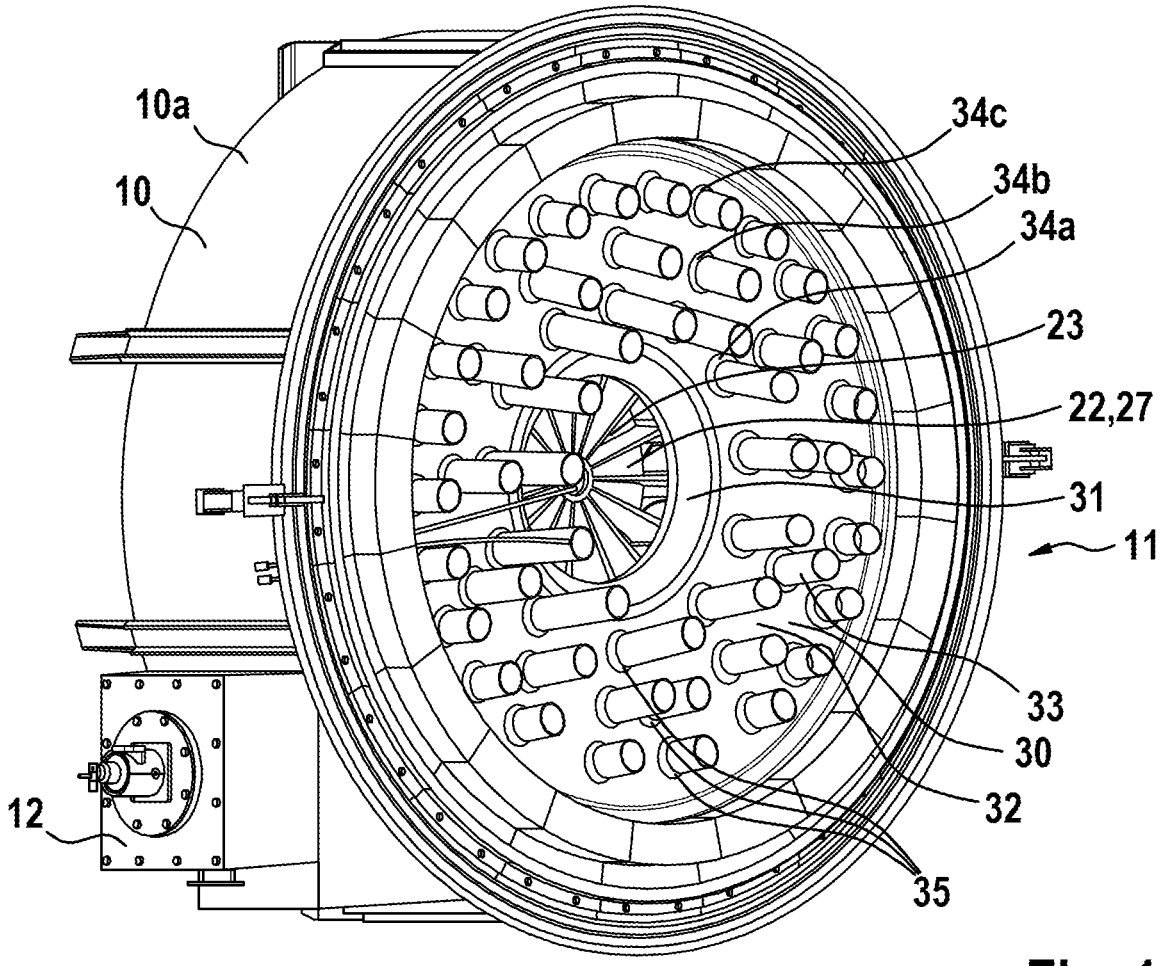

(51) Int. Cl.

| | |
|---|---|
| ***C21D 1/767*** | (2006.01) |
| ***F27B 11/00*** | (2006.01) |
| ***C21D 9/00*** | (2006.01) |
| ***C22F 1/04*** | (2006.01) |
| ***F27B 5/16*** | (2006.01) |
| ***F27D 3/00*** | (2006.01) |

(52) U.S. Cl.
CPC ..... *F27B 5/14* (2013.01); *F27B 5/16* (2013.01); *F27B 11/00* (2013.01); *F27D 3/0024* (2013.01); *F27B 2005/168* (2013.01); *F27B 2005/169* (2013.01); *F27D 2007/045* (2013.01)

(58) Field of Classification Search
CPC .... F27B 2005/169; F27D 7/04; F27D 3/0024; F27D 2007/045; C22F 1/04
See application file for complete search history.

(56) References Cited

U.S. PATENT DOCUMENTS

| | | | | |
|---|---|---|---|---|
| 4,789,333 | A * | 12/1988 | Hemsath ..... | C21D 1/767 432/176 |
| 5,449,422 | A | 9/1995 | Pflanz et al. | |
| 7,264,467 | B1 | 9/2007 | Mitchell et al. | |

FOREIGN PATENT DOCUMENTS

| | | | |
|---|---|---|---|
| DE | 4243127 | A1 | 6/1994 |
| JP | 2014114510 | A | 6/2014 |
| KR | 101658877 | B1 | 9/2016 |

* cited by examiner

BATCH FURNACE FOR ANNEALING MATERIAL AND METHOD FOR HEAT TREATMENT OF A FURNACE MATERIAL

The invention relates to a batch furnace for annealing material and a method for heat treatment of a furnace material. A conventional batch furnace is described in, for example, DE 42 43 127 A1.

In industrial furnace building a distinction is made between continuous furnaces and batch furnaces. Batch furnaces have a closed furnace chamber in which an individual batch is heat-treated. Examples for batch furnaces are single-coil furnaces which allow a flexible and individual heat treatment of individual coils. A further example for a batch furnace are so-called chamber furnaces which are used for the heat treatment of coils, slabs and billets.

The batch furnace known from the initially mentioned DE 42 43 127 A1 substantially comprises a fan, a heating unit, nozzle boxes for guiding the hot gas stream and hot gas nozzles. The hot gas nozzles are in this case combined in nozzle plates for heating the coil. In order to enable a uniform temperature distribution on the coil and to avoid local excess temperatures at the coil, coil and hot gas stream are moved relative to one another. The relative movement of coil and hot gas stream is accomplished by rotatable bearing blocks arranged outside the furnace or by a pendulum oscillatory system in which the coil and/or the nozzle plates can be co-connected.

In general, the known chamber furnaces and single-coil furnaces have a complex construction and are relatively large which results in correspondingly high energy losses or requires correspondingly comprehensive heat insulating measures.

It is the object of the invention to provide a batch furnace for annealing material which allows a compact furnace size due to an improved structure and reduces energy losses due to an increased efficiency of the heat treatment. It is furthermore the object of the invention to provide a method for heat treatment of a furnace material.

The invention is based on the idea of providing a batch furnace for annealing material comprising a furnace housing which has a closable loading opening, a receiving chamber for furnace material and a device for convective heat transfer to the furnace material by a heat transfer medium. The device for convective heat transfer comprises at least one heating device and at least one fan which is arranged in the furnace housing. The receiving chamber is arranged on the suction side of the fan and at least one nozzle array is arranged on the pressure side of the fan. In this case, the nozzle array has a central opening which forms an intake duct of the fan. The nozzle array projects radially beyond the fan.

The invention has various advantages:

The heat transfer medium is guided specifically onto the furnace material or onto the coil by the nozzle array on the pressure side of the fan. In this case, the nozzle array projects radially beyond the fan so that a pressure duct is advantageously formed on the pressure side of the fan. In the pressure duct the heat transfer medium accelerated by the fan is compressed. The heat transfer medium then flows at high speed through the nozzle array into the receiving chamber directly onto the furnace material or coil. As a result of the increase in the speed of the heat transfer medium, the efficiency of the device for convective heat transfer to the furnace material increases. Thus, the efficiency of the batch furnace during the heat treatment is definitively increased. This further enables a reduction in the energy required for the heat treatment.

The nozzle array comprises the intake duct which is arranged on the suction side of the fan. Furthermore, the nozzle array delimits the pressure duct on a side of the pressure duct facing the receiving chamber. In this case, the nozzle array has nozzles by means of which the pressure side of the fan and therefore the pressure duct are in fluid communication with the receiving chamber. The nozzle array is therefore arranged in the suction side of the fan and on the pressure side of the fan. This advantageously allows a compact design of the batch furnace with the result that the space requirement of the furnace and the outer surface of the furnace to be insulated is reduced. Thus, heat losses or energy losses are reduced without addition heat insulation measures. Furthermore, as a result of the efficiently utilized furnace volume, flushing losses incurred when using a protective gas atmosphere are reduced.

Hot air, exhaust gas or protective gas, for example, are used as heat transfer medium depending on the furnace material.

The batch furnace according to the invention is particularly well suited for heat treatment of aluminium annealing material, in particular aluminium coils.

The heating device can be assigned to the fan. For example, the heating device is arranged directly downstream of the pressure side of the fan. The heating device can also be arranged upstream of the suction side of the fan. It is also possible that a heating device, in particular a first heating device is arranged directly upstream of the suction side of the fan and/or a heating device, in particular a second heating device, is arranged directly downstream of the pressure side of the fan. The heating device is arranged in the furnace housing in the same way as the fan.

If the heating device is arranged directly downstream of the pressure side of the fan, the cool heat transfer medium flows through the intake channel of the nozzle array into the fan and emerges from the fan again in the pressure side. The heat transfer medium is then guided onto the heating device and absorbs heat. The heat transfer medium then flows through the nozzle array into the receiving chamber. The nozzle array is configured in such a manner that the heated heat transfer medium is guided onto the furnace material located in the receiving chamber.

In gas-heated furnace installations, in principle a distinction is made between two possible types of heating. In one type of heating, the burner fires directly into the furnace. Here we talk of a direct heating device since the exhaust gases form the heat transfer medium. In the indirect heating device the burner fires inside a closed circuit into a tube, in particular a steel tube. In so doing, the hot tube transfers the heat to the heat transfer medium. This means that no exhaust gas enters into the furnace interior. In the aluminium sector both types are represented.

The fan arranged in the furnace housing has the result that compared to the known nozzle systems shorter flow paths and therefore lower pressure losses are achieved in the furnace housing.

In a particularly preferred embodiment, the fan and the nozzle array are arranged concentrically with respect to one another. This has the advantage that a uniform volume distribution of the heat transfer medium is made possible on the pressure side of the fan. The heat transfer medium is therefore guided uniformly through the nozzle array onto the furnace material with the result that a homogeneous heat treatment is made possible.

In a preferred embodiment the heating device is arranged concentrically with respect to the fan in a pressure duct between the fan and the furnace housing. In this case, the heating device for the heat transfer medium is arranged directly downstream of the pressure side of the fan in the furnace housing. The pressure duct is therefore formed on the pressure side of the fan. In this case, the heat transfer medium is advantageously guided through the fan directly onto the heating device. As a result, pressure losses are reduced and the efficiency of the heat absorption of the heat transfer medium is increased.

Preferably the nozzle array terminates in a fluid-tight manner at an inner wall of the furnace housing. The pressure duct thus forms a closed region on the pressure side of the fan, which allows a high compression of the heat transfer medium. This has the advantage that the heat transfer medium is guided at high pressure and therefore at high speed through the nozzle array into the receiving chamber onto the furnace material or coil. The efficiency of the convective heat transfer is thereby increased.

Further preferably the nozzle array is arranged directly upstream of the suction side of the fan. This enables a compact design of the batch furnace with the result that the space requirements and the outer surface of the furnace to be insulated is reduced.

The nozzle array comprises a funnel-shaped nozzle plate. As a result of the funnel-shaped configuration of the nozzle plate, the accelerated heat transfer medium is guided from the pressure side of the fan in a focused manner onto the furnace material. The nozzle array is thus also arranged on the pressure side of the fan. Advantageously, a specific heat treatment of the furnace material or coil is thereby made possible.

The nozzle plate is preferably configured to be annular. The nozzle plate in this case comprises the central opening which forms an intake duct of the fan.

In a preferred embodiment, the nozzle plate has a plurality of tubular and/or slot-shaped nozzles which are arranged around the centre of the nozzle plate on an inner side in at least one nozzle region in a circular manner. In this case, the inner side of the nozzle plate is facing the receiving chamber. The tubular and slot-shaped nozzles have the advantage that a bundling and an increase in the speed of the heat transfer medium is accomplished by each nozzle. Thus, a specific heat treatment of the furnace material is made possible and the efficiency of the convective heat transfer is increased.

Preferably the pressure side of the fan is in fluid communication with the receiving chamber through the tubular and/or slot-shaped nozzles. As a result of the connection of the pressure side of the fan to the receiving chamber, an inflow of the heat transfer medium onto the furnace material and equally a circulation of the heat transfer medium in the furnace housing is made possible.

The intake duct of the nozzle array is arranged directly opposite the suction side of the fan. This has the advantage that a compact and rectilinear design of the intake duct is possible. Thus, the pressure losses during intake of the heat transfer medium are reduced. The intake duct is formed between the fan and the receiving chamber for the circulation of the heat transfer medium. Through the intake duct the heat transfer medium is sucked in through the fan. As a result of the central configuration of the intake duct, a flow guidance of the heat transfer medium during the heat treatment of the furnace material in the furnace housing is advantageously improved.

In a particularly preferred embodiment, at least two fans are arranged in juxtaposition on both sides of the receiving chamber. Each fan is assigned at least one heating device and/or at least one inlet for an externally heated heat transfer medium. The heating device or the inlet for the externally heated heat transfer medium and the respectively assigned fan form a unit which forms the device for convective heat transfer. This embodiment has the advantage that the furnace material is uniformly heated from both sides. The embodiment is particularly suitable for heating coils, in particular aluminium coils and furthermore for other furnace materials.

Preferably in each case a fan has at least one flow duct which is arranged on the pressure side of the fan. The flow duct conducts the heat transfer medium to at least one heating device. The fan can also have several flow ducts which are arranged radially circumferentially on the fan.

Advantageously the heat transfer medium accelerated by the fan is guided or conducted through the flow ducts specifically to the heating device. As a result, the efficiency of the heat absorption of the heat transfer medium is increased by the heating device.

Further preferably at least one fan is formed by a radial fan. This enables the heat transfer medium to be sucked from the receiving chamber by the radial fan and released again radially with respect to the intake direction through the fan. The radial fan can thus be arranged on a housing end of the furnace housing since the heat transfer medium is sucked in from the receiving chamber or from the front. Advantageously a compact structure of the device for convective heat transfer and thus of the batch furnace results from this.

At least one fan has a drive which is arranged outside the furnace housing. This has the advantage that the fan drive is exposed to a relatively low thermal loading. Therefore no special heat-insulation or heat-dissipation measures are required for the drive.

The receiving chamber is configured to be substantially hollow symmetrical, wherein the fans are arranged on the front sides of the receiving chamber. As a result, a particularly compact design of the batch furnace is achieved which enables a rapid, efficient and homogeneous heating of the furnace material.

In a further preferred embodiment, the furnace housing has at least one inlet for an externally heated heat transfer medium. The position of the inlet for the externally heated heat transfer medium can be located at any point in the furnace. The inlet allows access to the furnace interior or to the receiving chamber for the furnace material so that the externally heated heat transfer medium can enter into the receiving chamber. For example, exhaust gases of another furnace installation are used as externally heated heat transfer medium. Preferably the inlet for the externally heated heat transfer medium is arranged directly downstream of the pressure side of the fan. The invention is not thereby restricted to this arrangement.

Through the inlet a heat transfer medium, preferably hot air and/or hot protective gas and/or when using a spray lance, hot exhaust gases can be supplied to the batch furnace, that is heated externally, i.e. outside the furnace. It is possible to combine one or more inlets for the externally heated heat transfer medium with one or more heating devices, for example, in order to bring a preheated heat transfer medium in the furnace to the desired end temperature by the heating device.

In a preferred embodiment, the heating device comprises a heating line for a gaseous heating medium. The heating device can be formed by a steel tube, in particular by a segment tube. The heating line can be arranged in the pressure duct running around the fan. The heating line is preferably arranged on the pressure side of the fan. The externally heated heat transfer medium can advantageously be guided through the heating line with the result that the heating line is heated. Furthermore the heat transfer medium circulating in the furnace housing is heated by the heated heating line.

In the method according to the invention for heat treatment of a furnace material with a batch furnace, the furnace material is arranged in a receiving chamber of the batch furnace. A heat transfer medium is guided by a fan, in particular a radial fan to a heating device. In this case, the heat transfer medium is heated by the heating device. Then the heated heat transfer medium is guided through a nozzle array (30) onto the furnace material for convective heat transfer.

For the advantages of the method for heat treatment of a furnace material using a batch furnace according to the invention, reference is made to the advantages explained in connection with the batch furnace. Furthermore, the method can alternatively or additionally comprise individual features or a combination of the plurality of features mentioned previously in relation to the batch furnace.

The invention is explained in detail hereinafter with further details with reference to the appended drawings. The depicted embodiments show examples of how the batch furnace according to the invention can be configured.

In the Figures

Figure 2:
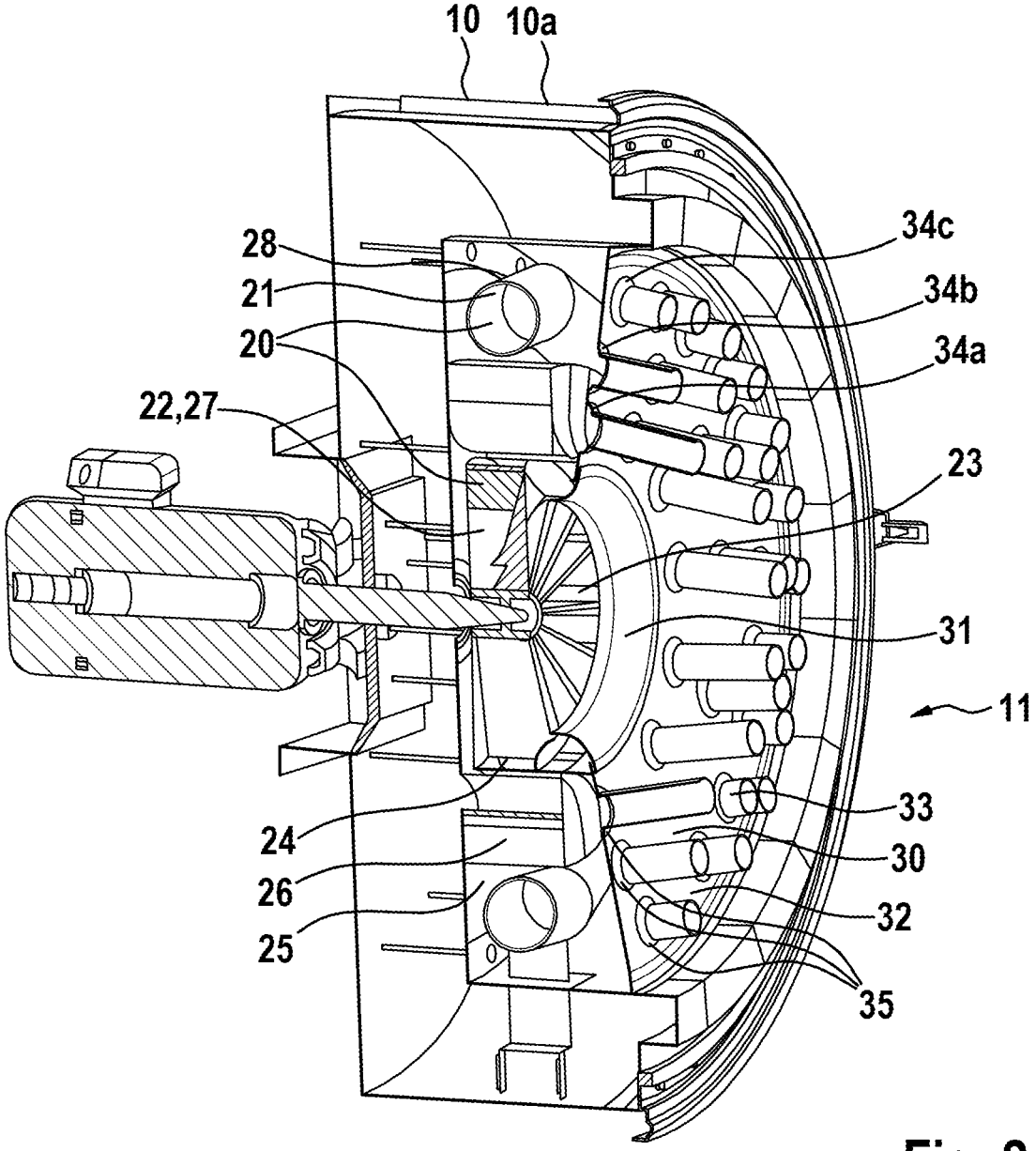

FIG. 1 shows a perspective view of a housing part of a batch furnace with a nozzle array according to one exemplary embodiment of the invention and FIG. 2 shows a perspective longitudinal sectional view through the housing part of the batch furnace according to FIG. 1.

A batch furnace with a housing part 10*a* of the furnace housing according to FIG. 1 is preferably used for the heat treatment of aluminium annealing material, for example of aluminium coils. The batch furnace can be generally used for coils (independent of material) or other annealing material. The batch furnace specifically involves a single coil furnace which is adapted for heat treatment of individual coils. The invention can also be applied to single-chamber furnaces which are suitable for the heat treatment of slabs, billets or coils.

The batch furnace comprises a furnace housing 10 which substantially comprises an aluminium receiving chamber 11, a closable loading opening not shown and one or more devices for convective heat transfer 20 to the furnace material through a heat transfer medium. The respective device for convective heat transfer 20 in this case comprises a heating device 21 and a fan 22. The device for convective heat transfer 20 will be discussed in detail subsequently.

The furnace housing 10 is configured to be hollow cylindrical, wherein a housing part 10*a* according to FIG. 1 is arranged in each case at an axial end of the furnace housing 10. Furthermore, the furnace housing 10 can also be formed by another furnace shape. For example, the furnace housing 10 has a rectangular furnace shape, in particular a box-shaped furnace shape. The furnace housing 10 can also have only one housing part 10*a*, for example, at an axial end of the furnace housing 10. The furnace housing 10 comprises a steel construction for stiffening the housing which is arranged on an outer surface of the furnace housing 10.

The housing part 10*a* has a circumferential shape contour in a circumferential region on a front side of the housing part 10*a*. The shape contour engages in the closed state of the furnace housing 10, in particular during operation of the batch furnace, in a complementary shape contour of a further housing part not shown, in particular a housing central part. The circumferential shape contour makes it possible to achieve a tight connection, for example, of the housing part 10*a* with the housing central part. The housing part 10*a* has two cylinders on the shape contour for securing the tight connection between the housing part 10*a* and the housing central part. The housing part 10*a* can also have a plurality of cylinders on the shape contour. The cylinders can in this case each be formed by a securing cylinder, in particular closure cylinder and/or locking cylinder. Furthermore, the housing part 10*a* has an inlet for an externally heated heat transfer medium. Likewise the housing part 10*a* has an outlet 12 for removal of burner gases into an exhaust gas line.

Furthermore, the furnace housing 10 has a thermal insulation which is arranged internally on the furnace housing 10. The thermal insulation protects the furnace housing 10 from damage due to impermissible effect of temperature during the heat treatment of the furnace material. Furthermore, energy losses during the heat treatment are reduced by the thermal insulation.

The furnace housing 10 can be formed in different variants which are not shown. In a first variant the furnace housing can be formed in three parts with an exchangeable housing central part, in particular a central piece. In this case, the housing central part is separated from the two lateral housing parts 10*a* so that the housing central part can be exchanged. The batch furnace can therefore be adapted according to length to different annealing material parts, in particular different coils.

In a second variant the furnace housing 10 can also be formed in three parts. Unlike the first variant, in the second variant the housing central part can be formed by a bottom piece. The bottom piece can have transport means, in particular rollers so that it is possible to move the housing central part transversely to the longitudinal direction of the batch furnace. The lateral housing parts 10*a* each have a housing extension in the longitudinal direction of the batch furnace. The housing extensions extend in this case in the direction of the receiving chamber 11. In the closed state of the batch furnace the housing extensions with the bottom piece form the receiving chamber 11, wherein the receiving chamber 11 is delimited laterally by the housing parts 10*a*. The furnace housing 10 can furthermore also be formed in a divided manner in another variant or in one piece.

The furnace housing 10 according to FIG. 1 therefore limits the receiving chamber 11 in which the furnace material or the annealing material is arranged during operation of the batch furnace. This is a single receiving chamber 11. In the batch furnace with the furnace housing 10, the receiving chamber 11 can be loaded with a coil, in particular an aluminium coil. To this end, the receiving chamber 11 can have a bearing device for the furnace material, in particular for the aluminium coil. For example the bearing device is formed by a bearing block or a bearing linkage. The bearing device can be connected to the bottom of the receiving chamber 11. For example, the coil can also be laid on its lateral surface. The coil can also be stored differently in the receiving chamber 11. The receiving chamber 11 is configured to be substantially hollow cylindrical and therefore approximately adapted to the shape of the coil to be heated. The receiving chamber 11 forms an empty free space in the unloaded state of the batch furnace. The receiving chamber 11 is in this case accessible through a closable loading opening not shown.

The loading opening can be opened or closed by a cover which can be pivoted about a longitudinal axis of rotation running in the longitudinal direction of the furnace housing 10. Here a coil gripper can be used for loading the receiving chamber 11. This design is particularly suitable for cylindrical furnace housings. Furthermore the loading opening can be opened or closed by an axial displacement of the lateral housing parts 10*a* so that the receiving chamber 11 can be loaded by a C hook or a fork lift truck. For example, in a further design of the furnace housing 10 a lateral housing part 10*a* or both lateral housing parts 10*a* are pivotable about a transverse axis of rotation running transversely to the longitudinal direction of the furnace housing 10. The loading opening can also be opened or closed by another non-specified design of a cover or a housing element.

In the perspective view according to FIG. 1, the fan 22 of the device for convective heat transfer 20 and a nozzle array 30 is further shown. The nozzle array 30 is arranged on a pressure side 24 of the fan 22 not shown. Furthermore, the nozzle array 30 has a central opening which forms an intake duct 31 of the fan 22. Here the fan 22 and the nozzle array 30 are arranged concentrically with respect to one another. The intake duct 31 is thus formed between the fan 22 and the receiving chamber 11 for circulation of the heat transfer medium. Furthermore, the intake duct 31 can also be formed by an opening which is formed at any position, in particular a decentralized position in the nozzle array 30. Furthermore, the fan 22 and the nozzle array 30 can also be arranged eccentrically with respect to one another. The nozzle array 30 projects radially beyond the fan 22. The nozzle array 30 is configured in such a manner that the nozzle array 30 terminates in a fluid-tight manner at the inner wall of the furnace housing 10. For example, the nozzle array 30 is configured in such a manner that a spacing is formed between a radial outer side, in particular a circumference, of the nozzle array 30 and the inner wall of the furnace housing 10. The spacing between the nozzle array 30 and the inner wall of the furnace housing 10 can be formed by an annular gap.

The nozzle array 30 is arranged directly upstream of the suction side 23 of the fan 22. This allows a compact construction of the fan 22 with the nozzle array 30 in the furnace housing 10. Advantageously the receiving chamber 11 can thereby be enlarged with the same dimensions of the furnace housing 10 or the dimensions of the furnace housing can be reduced. Thus, the overall size of the batch furnace can be reduced.

The fan 22 is in fluid communication with the receiving chamber 11 of the furnace material through the intake duct 31 of the nozzle array 30. The intake duct 31 of the nozzle array 30 is therefore arranged directly opposite the suction side 23 of the fan 22. The nozzle array 30 according to FIG. 1 has a funnel-shaped nozzle plate 32. The nozzle plate 32 is in this case configured to be circular. The nozzle plate 32 can also be formed by different geometrical shapes. Furthermore the nozzle plate 32 comprises a plurality of tubular nozzles 33. The tubular nozzles 33 are in this case arranged around a centre on an inner side of the nozzle plate 32. For example, the nozzles 33 also have a square or polygonal cross-sectional shape. In particular, the nozzles 33 can also be configured to be slot-shaped. The nozzles 33 can also have different cross-sectional shapes. Furthermore the nozzles 33 can be configured to be tapered towards one side. For example, the nozzle plate 32 has nozzles 33 with different cross-sectional shapes and/or nozzle lengths.

In the following description, the nozzle circles 34*a*, 34*b*, 34*c* with identical or approximately identical properties are designated as nozzle circles 34.

According to FIG. 1, a plurality of tubular nozzles 33 are arranged in a plurality of circular nozzle regions 35 on the inner side of the nozzle plate 32. The nozzle regions 35 can in this case also be configured differently. For example, the nozzle regions 35 can be configured to be star-shaped. In particular, the nozzle regions 35 can also be configured to be parallel to one another. The respective nozzles 33 can thus be arranged at different positions on the nozzle plate 32. As can be seen in FIG. 1, the nozzle regions 35 are formed by an inner nozzle circle 34*a*, a middle nozzle circle 34*b* and an outer nozzle circle 34*c*. The inner nozzle circle 34*a* is in this case arrange don the nozzle plate 32 adjacent to the intake duct 31 of the fan 22. The outer nozzle circle 34*c* is arranged on the nozzle plate 32 adjacent to the inner wall of the furnace housing 10. The middle nozzle circle 34*b* is arranged interposed between the inner nozzle circle 34*a* and the outer nozzle circle 34*c* on the nozzle plate 32. The nozzle circles 34 each have a spacing with respect to one another. In other words the nozzle circles 34 have different diameters.

The inner side of the nozzle plate 32 is facing the receiving chamber 11. Thus, an outer side of the nozzle plate 32 is facing the pressure side of the fan 22. The nozzle plate 32 is configured to be funnel-shaped in such a manner that during the heat treatment of the furnace material the nozzles 33 of respectively one nozzle region are directed directly onto the furnace material. The respective nozzle circles 34 have nozzles 33 with an identical nozzle length. The nozzles 33 of the inner nozzle circle 34*a* are configured to be longer here than the nozzles 33 of the middle nozzle circle 34*b*. The nozzles 33 of the middle nozzle circle 34*b* are configured to be longer here than the nozzles of the outer nozzle circle 34*c*. In other words, the length of the nozzles 33 decreases starting from the centre of the nozzle plate 32 towards the outside towards the circumference of the nozzle plate 32. The lengths of the nozzles 33 of the nozzle circles 34 are configured in such a manner that the nozzles 33 in a side view of the nozzle array 30 not shown are configured to be vertically aligned with respect to one another with their free nozzle ends. In other words, the respective free ends of the nozzles 33 form a vertical alignment in the side view. The respective nozzle circles 34 can also comprise nozzles 33 with different nozzle lengths.

According to FIG. 2, a perspective longitudinal sectional view of the housing part 10*a* according to FIG. 1 is shown. The furnace housing 10, the housing part 10*a* and the nozzle array 30 are implemented as described previously in FIG. 1. Likewise the arrangement of the nozzle array 30 and the fan 22 in the furnace housing 10 or housing part 10*a* according to FIG. 2 corresponds to the arrangement of the nozzle array 30 and the fan 22 as described previously in FIG. 1.

As shown in FIG. 2, the housing part 10*a* has a device for convective heat transfer 20. The device for convective heat transfer 20 here comprises a heating device 21 and a fan 22. For example, the device for convective heat transfer 20 also comprises a plurality of heating devices 21 and/or a plurality of fans 22.

In the housing part 10*a* according to FIG. 2, the fan 22 has a drive, in particular an electric motor which is arranged outside the furnace housing 10. The drive is directly coupled in a known manner to the fan 22. For example, the drive is connected by a belt drive or by a transmission to the fan 22. A rotor of the fan 22 is arranged in the furnace housing 10. According to FIG. 2, the fan 22 is formed by a radial fan 27. The radial fan 27 has a plurality of flow ducts 26 which are arranged on the pressure side 24 of the radial fan 27. The flow ducts 26 are in this case arranged radially circumferentially directly on the radial fan 27. For example, the flow ducts 26 are arranged completely radially circumferentially on the radial fan 27. The flow ducts 26 can also be arranged partially radially circumferentially on the radial fan 27.

The radial fan 27 is assigned the heating device 21. The radial fan 27 can be assigned a plurality of heating devices 21. The heating device 21 is arranged concentrically to the radial fan 27 in a pressure duct 25 between the furnace housing 10 and the radial fan 27. The heating device 21 is in this case arranged directly downstream of the flow ducts 26 on the pressure side 24 of the radial fan 27 in the pressure duct 25.

As can be seen in FIG. 2, the heating device 21 is formed by a heating line 28 for gaseous heating medium. The heating line 28 is here arranged to run around the radial fan 27 in the pressure duct. Furthermore, the heating line 28 is formed by a tube, in particular by a steel tube. The tube can be configured as a segment pipeline. The heating line 28 can also be formed by a hose, in particular a flexible steel hose. Furthermore, the heating line 28 can also be formed by a different design and from different materials. The heating line 28 is connected to an inlet not shown for an externally heated heat transfer medium, in particular that for gaseous heating medium, which heats the heating line 28. For example, hot air and/or hot protective gas and/or also hot exhaust gases can also be used as externally heated heat transfer medium.

The pressure duct 25 is formed on the pressure side 24 of the radial fan 27. The pressure duct 25 is formed by a rear wall, a radially circumferential side wall and the nozzle array 30. Furthermore the pressure duct 25 is in fluid communication with the receiving chamber 11 through the nozzles 33 of the nozzle array 30. The pressure duct 25 is thus delimited by the nozzle plate 32 of the nozzle array 30 on the side facing the receiving chamber 11. The nozzle array 30 is therefore also arranged on the pressure side 24 of the fan 27.

During operation of the batch furnace for the heat treatment of furnace material, the heat transfer medium is sucked in through the intake duct 31 of the nozzle array 30 from the receiving chamber 11 through the radial fan 27. A front side of the radial fan 27 thereby forms the suction side 23. The heat transfer medium is then deflected in a radial direction to the intake direction of the heat transfer medium by the radial fan 27 and accelerated. Finally the heat transfer medium is guided through the flow ducts 26 directly to the heating device 21. Advantageously the efficiency of the heat absorption of the heat transfer medium from the heating device is thereby increased. The heat transfer medium is thus heated in the pressure duct 25 by the heating device 21. Likewise the heat transfer medium is compressed by the radial fan 27 in the pressure duct 25. The heat transfer medium is then passed through the nozzles of the nozzle array 30 for convective heat transfer to the furnace material.

REFERENCE LIST

10 Furnace housing
11 Receiving chamber
12 Outlet for removal of burner gases
20 Device for convective heat transfer
21 Heating device
22 Fan
23 Suction side
24 Pressure side
25 Pressure duct
26 Flow duct
27 Radial fan
28 Heating line
30 Nozzle array
31 Intake duct
32 Nozzle plate
33 Nozzle
34 Nozzle circle
34*a* Inner nozzle circle
34*b* Middle nozzle circle
34*c* Outer nozzle circle
35 Nozzle region

The invention claimed is:

1. A batch furnace for annealing material comprising: a furnace housing which has a closable loading opening, a receiving chamber for furnace material, and a device for convective heat transfer to the furnace material by a heat transfer medium, the device for convective heat transfer including a heating device and a fan which is arranged in the furnace housing, the receiving chamber arranged on a suction side of the fan, and a nozzle array arranged on a pressure side of the fan and that projects radially beyond the fan, wherein the nozzle array and the receiving chamber are positioned relative to one another so that during operation, the heat transfer medium flows through the nozzle array into the receiving chamber directly onto the furnace material for convective heat transfer, and the nozzle array includes a central opening which forms an intake duct of the fan, a nozzle plate with an inner side that faces the receiving chamber, and a plurality of nozzles having nozzle ends that protrude beyond the nozzle plate, the plurality of nozzles disposed on the inner side of the nozzle plate so that during the operation, the nozzle ends are directed directly at the furnace material and the heat transfer medium flows from the nozzle ends directly at the furnace material in the receiving chamber.

2. The batch furnace according to claim 1, wherein the fan and the nozzle array are arranged concentrically with respect to one another.

3. The batch furnace according to claim 1, wherein the heating device is arranged concentrically with respect to the fan in a pressure duct between the fan and the furnace housing.

4. The batch furnace according to claim 1, wherein the nozzle array terminates in a fluid-tight manner at an inner wall of the furnace housing.

5. The batch furnace according to claim 1 wherein the nozzle array is arranged directly upstream of the suction side of the fan.

6. The batch furnace according to claim 1, wherein the nozzle plate is a funnel-shaped nozzle plate.

7. The batch furnace according to claim 6, wherein the funnel-shaped nozzle plate is configured to be annular.

8. The batch furnace according to claim 6, wherein the plurality of nozzles are tubular and/or slot-shaped and are arranged around a centre of the nozzle plate on an inner side in at least one nozzle region in a circular manner.

9. The batch furnace according to claim 8, wherein the pressure side of the fan is in fluid communication with the receiving chamber through the plurality of nozzles.

10. The batch furnace according to claim 1, wherein the central opening of the nozzle array is arranged directly opposite the suction side of the fan.

11. The batch furnace according to claim 1, wherein the intake duct is formed between the fan and the receiving chamber for the circulation of the heat transfer medium.

12. The batch furnace according to claim 1, further comprising at least two of the fans arranged in juxtaposition on both sides of the receiving chamber, wherein each of the fans is assigned at least one of the heating device and/or at least one inlet for an externally heated heat transfer medium.

13. The batch furnace according to claim 1, wherein the fan has at least one flow duct which is arranged on the pressure side of the fan and the flow duct conducts the heat transfer medium to the heating device.

14. The batch furnace according to claim 1, wherein the fan is a radial fan.

15. The batch furnace according to claim 1, wherein the fan has a drive which is arranged outside the furnace housing.

16. The batch furnace according to claim 1, wherein the receiving chamber is configured to be a substantially hollow cylinder, wherein the fan is arranged on a front side of the receiving chamber.

17. The batch furnace according to claim 1, wherein the furnace housing has at least one inlet for an externally heated heat transfer medium.

18. The batch furnace according to claim 1, wherein the heating device comprises a heating line for a gaseous externally heated heat transfer medium.

19. A method for heat treatment of a furnace material with the batch furnace according to claim 1, the method comprising:

arranging the furnace material in the receiving chamber of the batch furnace;

guiding the heat transfer medium by the fan to the heating device;

heating the heat transfer medium with the heating device; and guiding the heated heat transfer medium through the plurality of nozzles of the nozzle array directly onto the furnace material for convective heat transfer.

20. The method according to claim 19, wherein the fan is a radial fan.

* * * * *